US010877506B1

(12) United States Patent
Herd

(10) Patent No.: US 10,877,506 B1
(45) Date of Patent: Dec. 29, 2020

(54) CRANK HANDLE ASSEMBLY

(71) Applicant: EZ CRANK INC., Logansport, IN (US)

(72) Inventor: Brian Herd, Logansport, IN (US)

( * ) Notice: Subject to any disclaimer, the term of this patent is extended or adjusted under 35 U.S.C. 154(b) by 0 days.

(21) Appl. No.: 16/827,941

(22) Filed: Mar. 24, 2020

(51) Int. Cl.
*G05G 1/08* (2006.01)
*E06B 9/76* (2006.01)

(52) U.S. Cl.
CPC ..... *G05G 1/085* (2013.01); *E06B 9/76* (2013.01)

(58) Field of Classification Search
CPC ..... G05G 1/085; E06B 9/76
See application file for complete search history.

(56) References Cited

U.S. PATENT DOCUMENTS 6,179,534 B1 * 1/2001 Weckter ..... B60P 7/0846 242/395
8,032,999 B2 * 10/2011 Herd ..... G05G 1/503 29/402.03

FOREIGN PATENT DOCUMENTS

EP 2581335 A1 * 4/2013 ..... B66D 1/7431

OTHER PUBLICATIONS

Translation EP-2581335.*
USPTO, Notice of Allowance for U.S. Appl. No. 12/148,688, dated Jul. 21, 2011.
Brian Herd, Amendment for U.S. Appl. No. 12/148,688, dated Jun. 9, 2011.
USPTO, Non-Final Office Action for U.S. Appl. No. 12/148,688, dated Mar. 16, 2011.
Morton Machine Works, Catalog, 2006, pp. 1-128, http://www.mortonmachine.com/download/MortonCatalog.pdf.

* cited by examiner

*Primary Examiner* — Vicky A Johnson
(74) *Attorney, Agent, or Firm* — D'Hue Law LLC; Cedric A. D'Hue

(57) ABSTRACT

In combination with a crank assembly, the improvement comprising an apparatus for improving operation of the crank assembly. The apparatus includes an an end cap of a predetermined material, an elongated extension member having each of a predetermined shape, a first predetermined length and formed of a first predetermined material, such predetermined shape includes a projection on one end thereof for engagement with one end of the crank assembly. A sleeve is disposed around at least a portion of the elongated extension member, such sleeve having a second predetermined length and formed of a second predetermined material. There is a means for securing the sleeve to the elongated handle member.

18 Claims, 8 Drawing Sheets

CRANK HANDLE ASSEMBLY

FIELD OF DISCLOSURE

The present disclosure relates, in general, to a handle of a crank, and, more particularly, the present disclosure relates to an improved handle design for use with a crank for lifting or lowering a trailer and can also be used for opening and closing hopper doors on bottom hopper trailers used for carrying grain.

BACKGROUND

Existing crank design makes raising and lowering a trailer difficult to perform. With a metal collar and a metal handle that is crimped together as is frequently done, these cranks catch as they are rotated, making it hard to turn them properly since it is important that the handle portion spin freely. With a metal collar and a metal handle on existing cranks, typical cranks can catch as they are rotated, making it hard to turn them properly. When the handle and the crank are rusted they will not turn at all. The crank and the handle of existing units are made of steel wherein the handle portion can rust onto the crank and locks up and will not turn. Since the handle portion has to be able to turn freely this poses a problem with the existing crank systems. All of these deficiencies create a time consuming, labor-intensive process.

U.S. Pat. No. 8,032,999 addresses these issues by providing a handle portion that spins freely. Existing handle designs face other challenges such as hitting the ground, such as if the handle or crank assembly is dropped or operated near the ground. Handles may break, crack or fracture from hitting the ground or from hitting other objects during use.

Thus it would be advantageous if there were a tool that would operate more efficiently that the presently used cranks.

SUMMARY

In a first aspect the present disclosure provides a handle configured to be coupled to the distal end of a crank assembly comprising an elongated extension member, the elongated extension member having a generally cylindrical shape, the generally cylindrical shape having a first cylindric section, a second cylindric section and a third cylindric section, the three cylindric sections separated by two right sections; the second cylindric section between the first and third cylindric sections, the first cylindric section having a first radius of approximately 1.109 inches and a first height of approximately 1.5 inches, wherein the first cylindric section is configured to engage an end of the crank assembly, the second cylindric section having a second radius of approximately 1 inch and a second height of approximately 4.04 inches, the third cylindric section having a third radius of approximately 0.62 inches and a height of approximately 0.365 inches, the third cylindric section defining a divot, the divot having a divot radius of approximately 0.531 inches and a divot height of approximately 0.047 inches, wherein the divot begins approximately 0.048 inches from the distal end of the third cylindric section, a sleeve having a generally cylindrical shape, the sleeve having a sleeve radius of approximately 1.375 inches and a sleeve height of approximately 3.469 inches, the sleeve having a sleeve internal diameter of approximately 1.016 inches, the sleeve configured to be located over the second cylindric section, a washer having a generally cylindrical shape, the washer having a washer radius of approximately 1.281 inches and a washer height of approximately 0.125 inches, the washer defining an internal diameter of approximately 1.005 inches, the washer configured to be located around the second cylindric section abutting the sleeve and the first cylindric section, an end cap having a generally cylindrical shape, the end cap having an end cap radius of approximately 1.375 inches, the end cap having an end cap height of approximately 0.7 inches, the end cap defining a first end cap internal diameter and a second end cap internal diameter, the first end cap internal diameter is approximately 0.625 inches, the second end cap internal diameter is approximately 1.106 inches, the third cylindric section configured to be located within the first end cap internal diameter, a distal portion of the second cylindric section configured to be located within the second end cap internal diameter, the end cap configured to abut the distal end of the sleeve, and a snap ring configured to be partially located with the divot and abutting the distal end of the end.

In a second aspect there is provided a method for improving operation of a crank assembly. The method comprises the steps of (a) providing a crank assembly, (b) providing a handle having an elongated extension member having a first cylindric section disposed on one end of the elongated extension member, the handle having a sleeve having a generally cylindrical shape located on a second cylindric section of the elongated extension member, wherein the second cylindric section abuts the first cylindric section, the handle having a washer having a generally cylindrical shape, the washer configured to be located around the second cylindric section, the washer abutting the sleeve and the first cylindric section, the handle having an end cap having a generally cylindrical shape, wherein a third cylindric section of the elongated extension member is configured to be located within a first end cap internal diameter of the end cap, a distal portion of the second cylindric section configured to be located within a second end cap internal diameter of the end cap, the end cap configured to abut the distal end of the sleeve, the handle having a snap ring configured to be partially located with the third cylindric section of the elongated extension member and abutting the distal end of the end cap, and (c) pressing the first cylindric section of the elongated extension member into distal end of the crank assembly.

In a third aspect there is further provided a step of removing at least a portion of an existing handle member of the crank assembly

OBJECTS OF THE DISCLOSURE

It is, therefore, one of the primary objects of the present disclosure to provide a crank handle for use with a crank for raising and lowering dollies on trailers that will make the rotational process smoother and easier.

Another object of the present disclosure is to provide a crank handle that will not rust onto the crank.

Still another object of the present disclosure is to provide a crank handle that will turn freely.

Yet another object of the present disclosure is to provide a crank handle that can either be retrofitted onto existing cranks or placed on new cranks.

Another object of the present disclosure is to provide a crank handle that can also be used with a crank to open and close doors on hopper bottom trailers used for hauling grain.

In addition to the various objects and advantages of the disclosure which have been described in some specific detail above it should be noted that various other objects and advantages of the present disclosure will become more readily apparent to those persons who are skilled in the relevant art from the following more detailed description, particularly when such description is taken in conjunction with the appended claims.

BRIEF DESCRIPTION OF THE DRAWINGS

The above-mentioned and other features of this disclosure, and the manner of attaining them, will become more apparent and the disclosure itself will be better understood by reference to the following description of embodiments of the disclosure taken in conjunction with the accompanying drawings, wherein:

Unless otherwise stated, a reference to a compound or component includes the compound or component by itself, as well as in combination with other compounds or components, such as mixtures of compounds.

As used herein, the singular forms "a", "an" and "the" include the plural reference unless the context clearly dictates otherwise.

All publications, patents and patent applications cited herein, whether supra or infra, are hereby incorporated by reference in their entirety to the same extent as if each individual publication, patent or patent application was specifically and individually indicated to be incorporated by reference.

Figure 1:
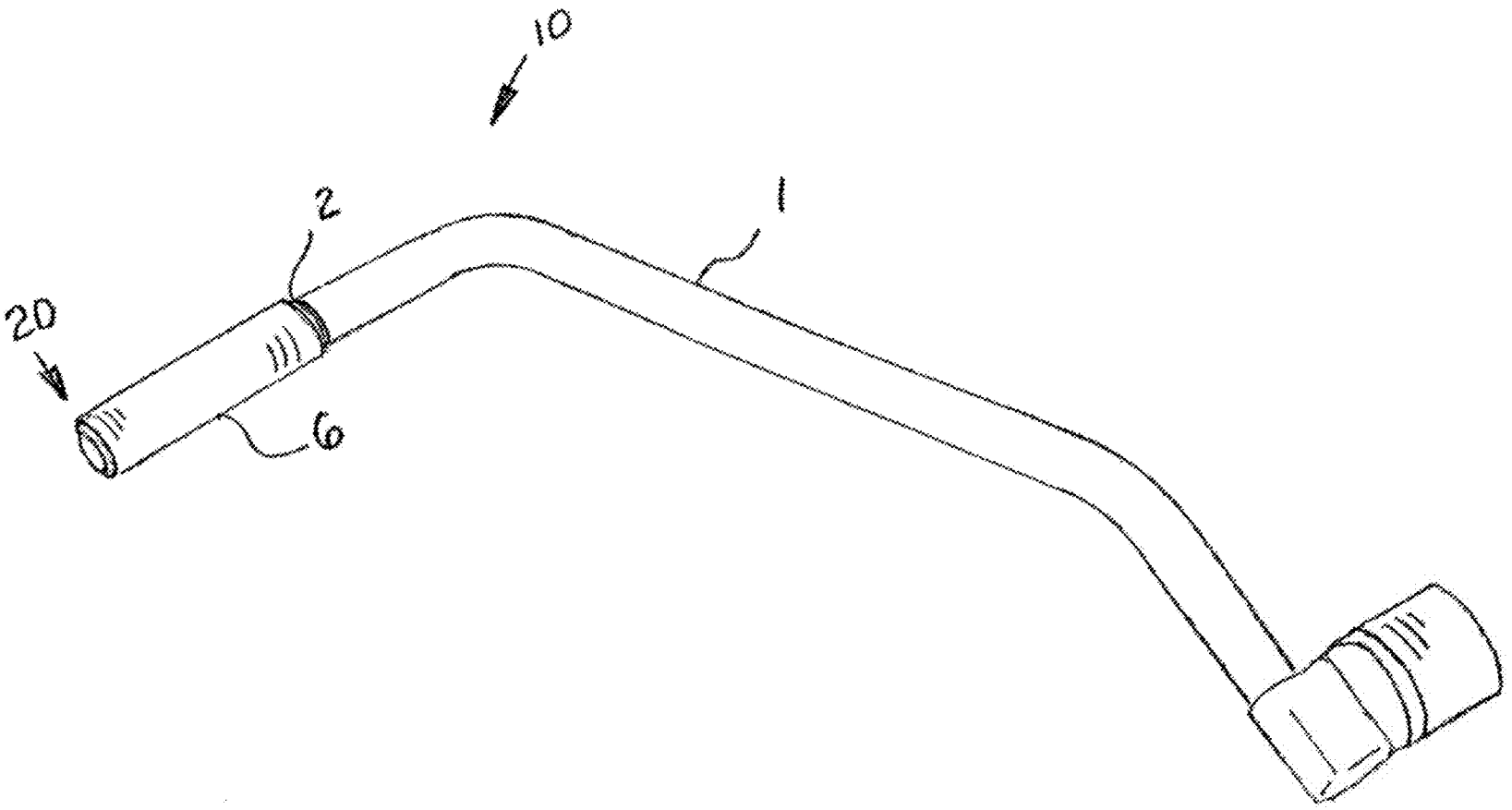

FIG. 1 is a perspective view of the crank assembly with the handle portion disclosure attached according to an embodiment of the disclosure.

Figure 2:
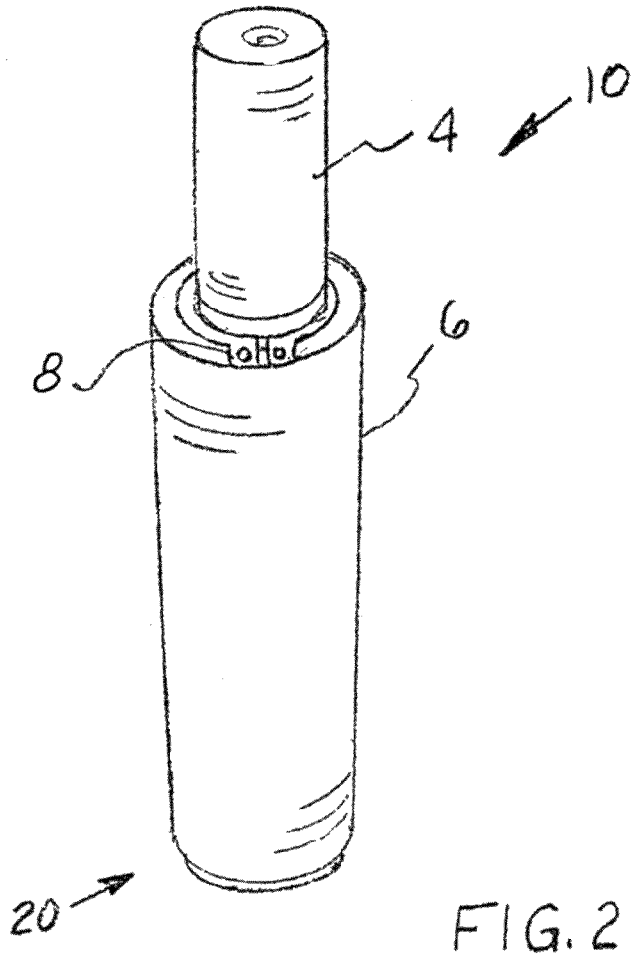

FIG. 2 is a top side perspective view of the present disclosure.

Figure 3:
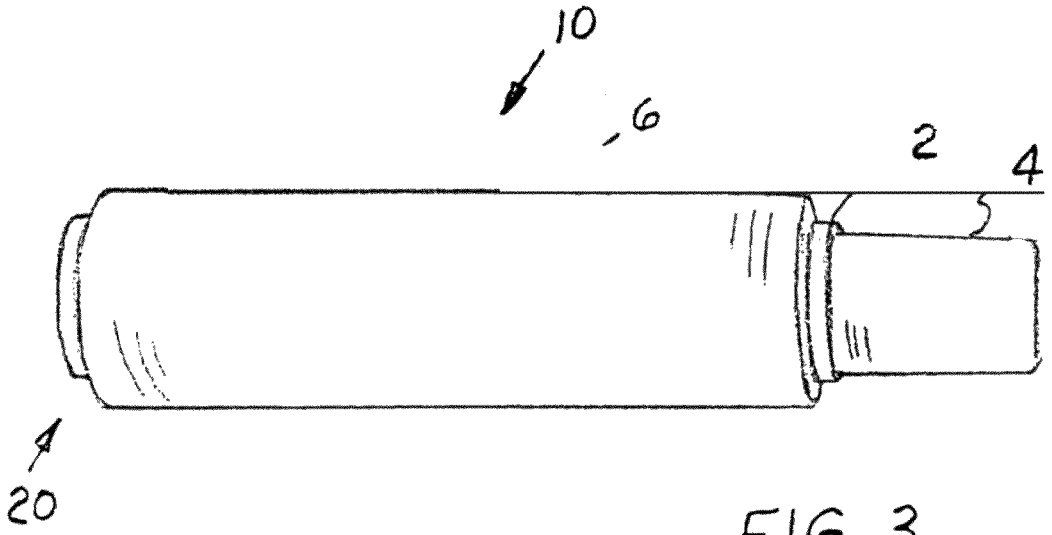

FIG. 3 is a side perspective view of the apparatus of the present disclosure.

Figure 4:
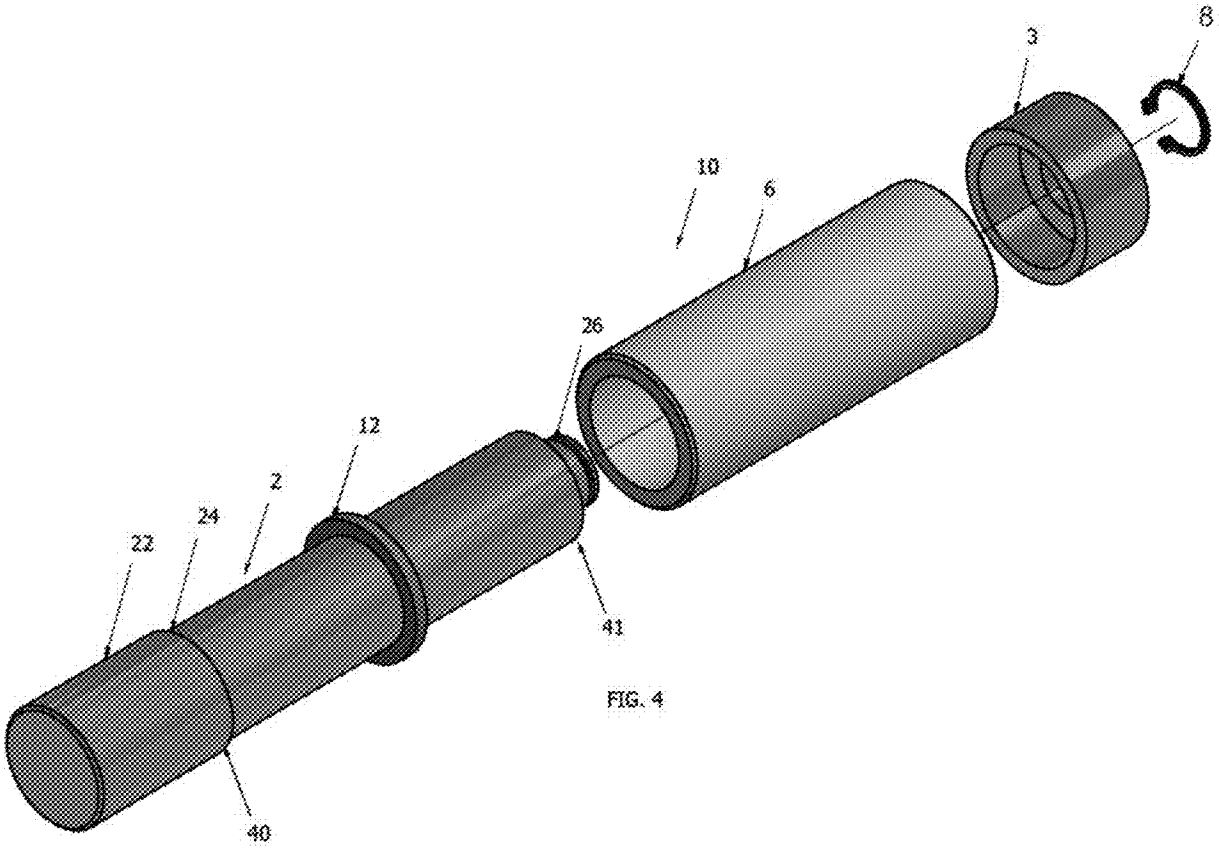

FIG. 4 is an exploded view of the handle of the present disclosure.

Figure 5:
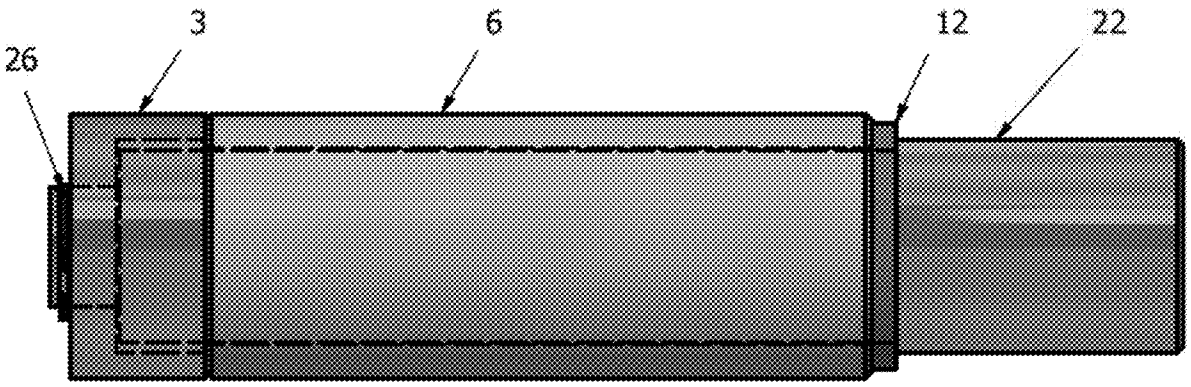

FIG. 5 is a perspective view of the handle of the present disclosure.

Figure 6:
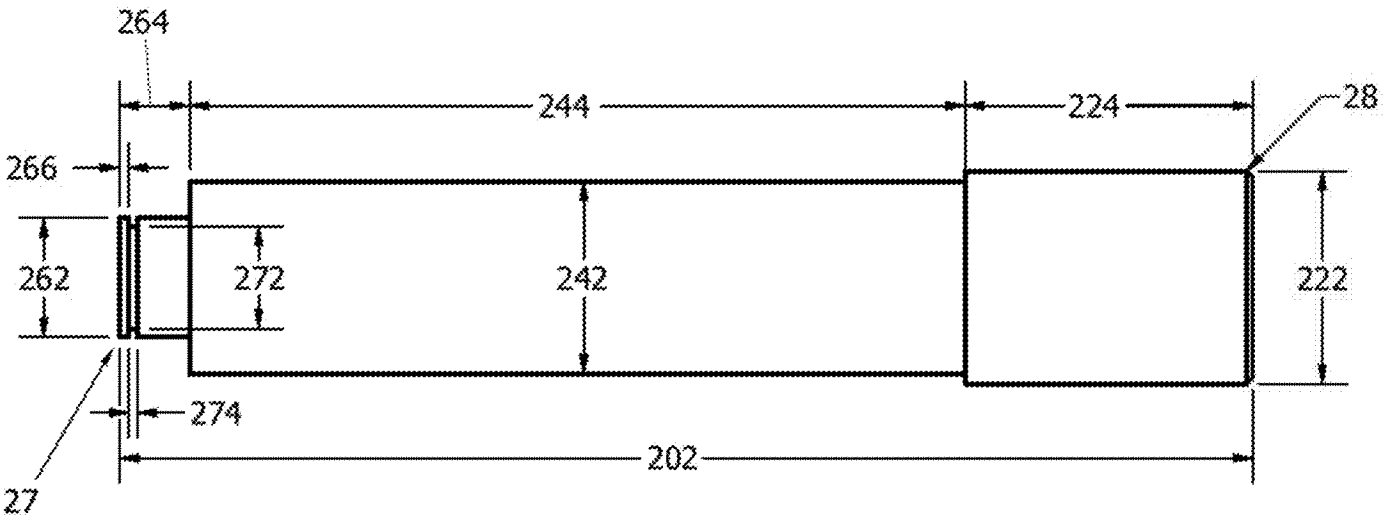

FIG. 6 is a schematic of the handle of the present disclosure.

Figure 7B:
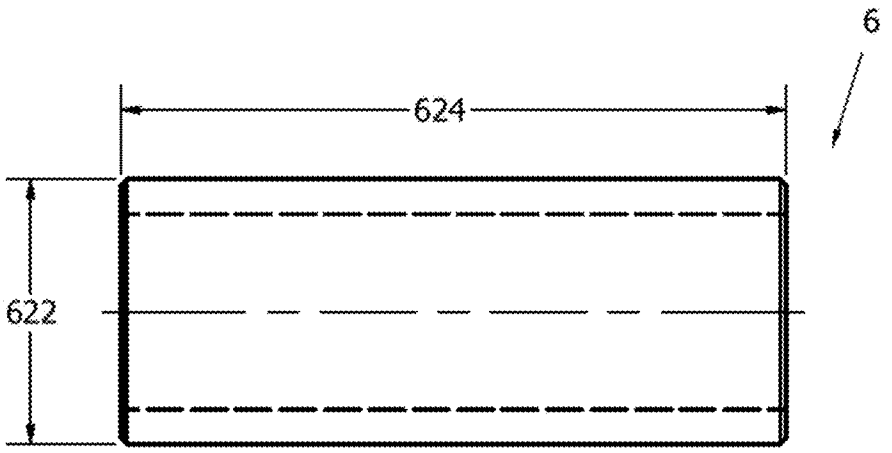
Figure 7A:
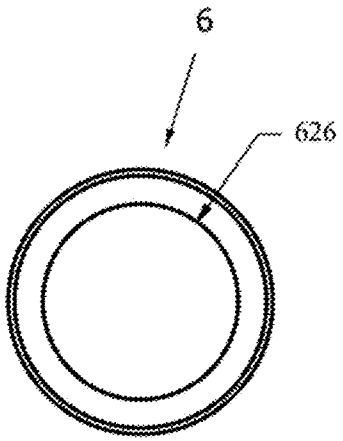

FIG. 7A is a schematic of the sleeve of the present disclosure.

FIG. 7B is a schematic of the sleeve of the present disclosure.

Figure 8B:
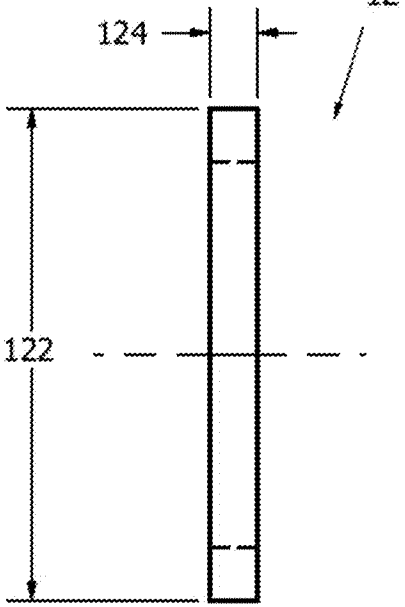
Figure 8A:
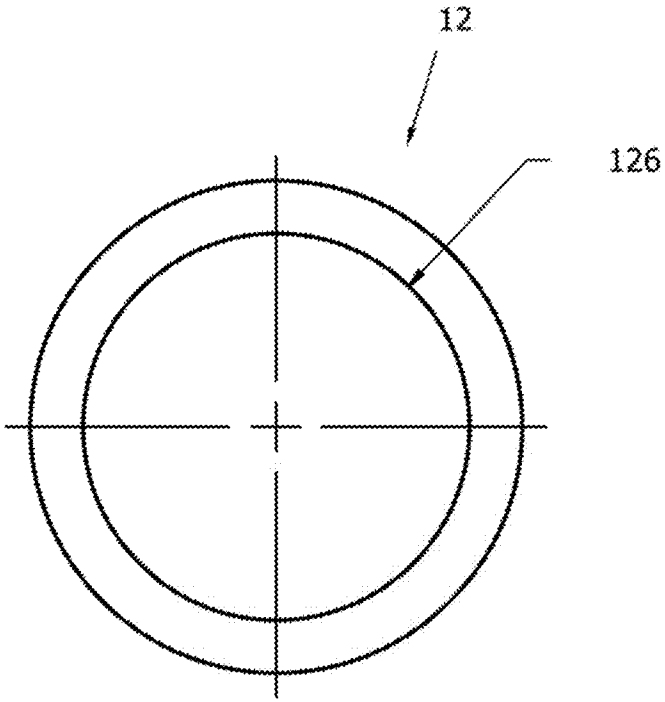

FIG. 8A is a schematic of the washer of the present disclosure.

FIG. 8B is a schematic of the washer of the present disclosure.

Figure 9B:
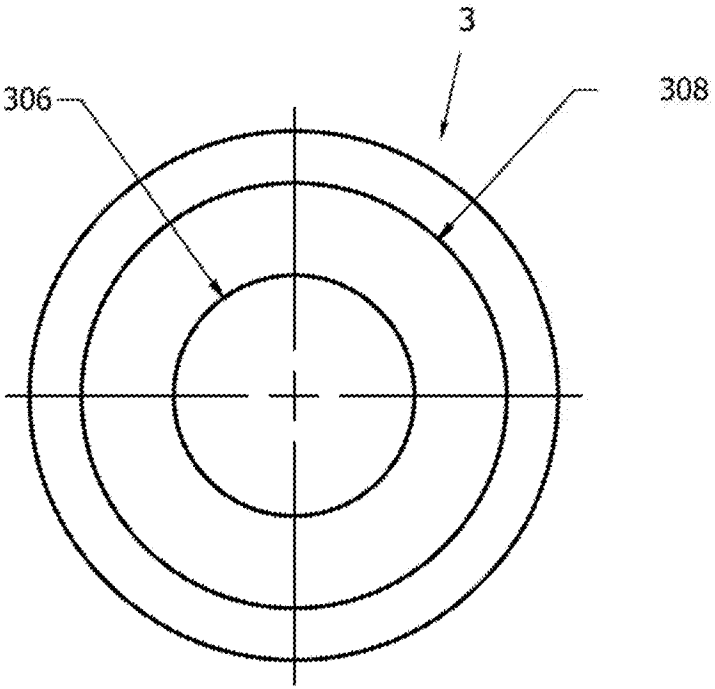
Figure 9A:
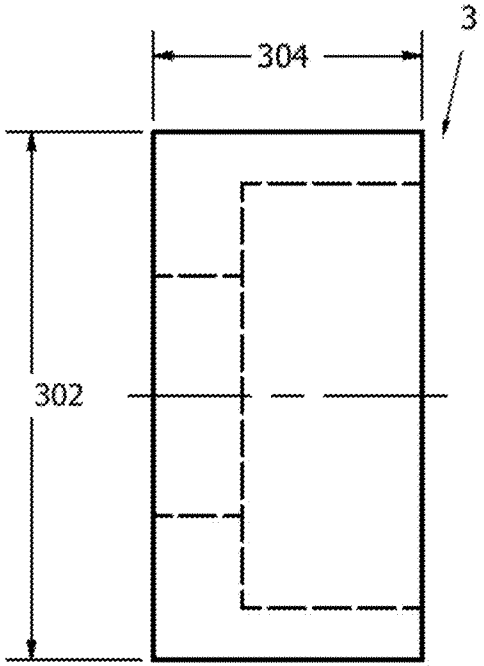

FIG. 9A is a schematic of the end cap of the present disclosure.

FIG. 9B is a schematic of the end cap of the present disclosure.

Corresponding reference characters indicate corresponding parts throughout the several views. Although the drawings represent embodiments of the present disclosure, the drawings are not necessarily to scale and certain features may be exaggerated in order to better illustrate and explain the present disclosure.

DETAILED DESCRIPTION OF THE EXEMPLARY EMBODIMENTS

The embodiments disclosed below are not intended to be exhaustive or limit the disclosure to the precise forms disclosed in the following detailed description. Rather, the embodiments are chosen and described so that others skilled in the art may utilize their teachings.

Prior to proceeding with the more detailed description of the present disclosure it should be noted that, for the sake of clarity, identical components which have identical functions have been designated by identical reference numerals throughout the several views illustrated in the drawings.

In a first aspect the present disclosure provides in combination with a crank assembly 1, a handle 10, for improving operation of the crank assembly 1. The handle 10 of the present disclosure will not rust as occurs quite frequently with existing handles.

The handle 10 includes an elongated extension member 2 having a generally cylindrical shape. The elongated extension member height 202 is between about 5.75 inches and about 6.25 inches, such as approximately 6 inches or approximately 5.905 inches. The elongated extension member includes a projection 4 (FIG. 2) disposed on one end thereof for engagement with one end of the crank assembly.

The elongated extension member 2 is formed of a first predetermined material, aluminum. It is preferred that such first predetermined material for forming the elongated extension member 2 is made of a material that does not rust and it is presently preferred that such material is aluminum. It is also preferred that such aluminum is a solid piece of aluminum for forming the elongated extension member 2.

The generally cylindrical shape has a first cylindric section 22, a second cylindric section 24 and a third cylindric section 26. The three cylindric sections are separated by two right sections. The second cylindric section 24 is between the first cylindric section 22 and third cylindric section 26.

As best illustrated in FIG. 6, the first cylindric section 22 has a first cylindric section radius 222 of approximately 1.109 inches and a first cylindric section height 224 of approximately 1.5 inches. The first cylindric section 22 defines a chamfer 28. The chamfer 28 has a chamfer height of approximately 0.3125 inches. The chamfer 28 is useful to help the first cylindric section 22 engage in a snug fit with the distal end of the crank assembly 1.

The second cylindric section 24 has a second cylindric section radius 242 of approximately 1 inch and a second cylindric section height 244 of approximately 4.04 inches. The third cylindric section 26 has a third cylindric section radius 262 of approximately 0.62 inches and a third cylindric section height 264 of approximately 0.365 inches.

The third cylindric section 26 defines a divot 27. The divot, has a divot radius 272 of approximately 0.531 inches and a divot height 274 of approximately 0.047 inches. The divot 27 begins approximately 0.048 inches from the distal end 266 of the third cylindric section 26. As seen in FIG. 4, the three cylindric sections are separated by two right sections 40 and 41.

The first cylindric section 22 is disposed on one end of elongated extension member 2 for engagement with the distal or user end of the crank assembly 1.

As best illustrated in FIGS. 7A and 7B, a sleeve 6 has a generally cylindrical shape. The sleeve 6 has a sleeve radius 622 of approximately 1.375 inches. It is also presently preferred that the sleeve height 624 is between about 3 inches and about 4 inches, such as approximately 3.469 inches. The sleeve 6 has a sleeve internal diameter 626 of approximately 1.016 inches. The sleeve 6 is configured to be located over or disposed around the second cylindric section 24 of the elongated extension member 2.

The sleeve 6 being formed of a second predetermined material, such as plastic, such as polyoxymethylene. The second predetermined material used to form the sleeve 6 is preferably plastic and that such plastic is a wear-resistant plastic. It is further preferred that such plastic is Delrin. Delrin is a polyoxymethylene (POM) and is a brand name of DuPont. POM is a polymer with the chemical formula —$(OCH_2)_n$—. POM is a lightweight, low friction, and wear resistant thermoplastic.

Thus, the elongated extension member 2 of the present disclosure is made of aluminum and the sleeve 6 is made of Delrin, neither of which will rust and, therefore, the handle 10 spins freely. The handle 10 and the crank 1 are used to raise and lower dollies on trailers and also in opening and closing doors on hopper bottom trailers that haul grain. There also may be other applications for the crank 1.

As best illustrated in FIGS. 8A and 8B, a washer 12 has a generally cylindrical shape. The washer 12 has a washer radius 122 of approximately 1.281 inches and a washer height 124 of approximately 0.125 inches. The washer 12 defines an internal diameter 126 of approximately 1.005 inches. The washer 12 is configured to be located around the second cylindric section 24 abutting the sleeve and the first cylindric section 22.

As best illustrated in FIGS. 9A and 9B, an end cap 3 has a generally cylindrical shape. The end cap 3 has an end cap radius 302 of approximately 1.375 inches. The end cap 3 has an end cap height 304 of approximately 0.7 inches. The end cap 3 defines a first end cap internal diameter 306 and a second end cap internal diameter 308. The first end cap internal diameter 306 is approximately 0.625 inches. The second end cap internal diameter 308 is approximately 1.106 inches. The third cylindric section 26 is configured to be located within the first end cap internal diameter 306. A distal portion of the second cylindric section 24 is configured to be located within the second end cap internal diameter 308. The end cap 3 is configured to abut the distal end of the sleeve 6. The end cap 3 is made of aluminum. The end cap 3 is located near the distal end of the handle 10.

There is, further, at least one snap ring 8 (FIG. 2) for securing sleeve 6 and end cap 3 to handle 10. The snap ring 8 is configured to be partially located with the divot 27 and abutting the distal end of the end cap 3. The snap ring 8 holds the sleeve 6, and the end cap 3 with the rest of the handle 10.

Thus, the present disclosure of a crank handle 10 improves on existing crank design, making the rotational process smoother and easier. The handle 10 is constructed of a non-rusting metal, preferably aluminum. The elongated extension member 2 is between about 5.75 inches and about 6.25 inches long. The elongated extension member 2 is covered with a sleeve 6 and an end cap 3. The end cap 3 is made of a predetermined material, preferably aluminum. It is presently preferred that such sleeve is plastic and that such plastic is POM.

In a second aspect there is provided a method for improving operation of a crank assembly 1. The method comprises the steps of providing a crank assembly 1 and optionally removing at least a portion of the existing handle member of the crank assembly 1.

There is a step of providing a handle having an elongated extension member having a first cylindric section 22 disposed on one end of the elongated extension member, the handle having a sleeve having a generally cylindrical shape located on a second cylindric section 24 of the elongated extension member, wherein the second cylindric section 24 abuts the first cylindric section 22, the handle having a washer 12 having a generally cylindrical shape, the washer 12 configured to be located around the second cylindric section 24, the washer 12 abutting the sleeve and the first cylindric section 22, the handle having an end cap having a generally cylindrical shape, wherein a third cylindric section of the elongated extension member is configured to be located within a first end cap internal diameter of the end cap, a distal portion of the second cylindric section 24 configured to be located within a second end cap internal diameter of the end cap, the end cap configured to abut the distal end of the sleeve, the handle having a snap ring configured to be partially located with the third cylindric section of the elongated extension member and abutting the distal end of the end cap, and pressing the first cylindric section 22 of the elongated extension member into the crank assembly. In an alternative embodiment of the method steps, the providing step is followed by sliding a sleeve 6 over a portion of the elongated extension member 2 and placing an end cap 3 followed by a step of securing the sleeve 6 and end cap 3 to the elongated extension member 2 by use of a snap ring.

The method also includes the step of using such crank assembly 1 for raising and lowering a dolly disposed on a trailer.

There is also a step of using the crank assembly for opening and closing doors on hopper bottom trailers used for hauling grain.

The method in the step of removing at least a portion of the existing handle member includes a step of chop sawing so as to remove the existing handle member.

In retrofitting an existing crank, one can simply chop saw off the old handle and press in the new EZ crank handle into the opening in the crank end. The handle can be fitted directly onto new cranks.

While a presently preferred embodiment and alternate embodiments of the present disclosure have been described in detail above, it should be understood that various other adaptations and/or modifications of the disclosure can be made by those persons who are particularly skilled in the art without departing from either the spirit of the disclosure or the scope of the appended claims.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. A handle configured to be coupled to the distal end of a crank assembly comprising:

an elongated extension member, the elongated extension member having a generally cylindrical shape, the generally cylindrical shape having a first cylindric section, a second cylindric section and a third cylindric section, the three cylindric sections separated by two right sections; the second cylindric section between the first and third cylindric sections, wherein the first cylindric section is configured to engage an end of the crank assembly, the third cylindric section defining a divot, a sleeve having a generally cylindrical shape, the sleeve configured to be located over the second cylindric section a washer having a generally cylindrical shape, the washer configured to be located around the second cylindric section abutting the sleeve and the first cylindric section, an end cap having a generally cylindrical shape, the end cap defining a first end cap internal diameter and a second end cap internal diameter, the third cylindric section configured to be located within the first end cap internal diameter, a distal portion of the second cylindric section configured to be located within the second end cap internal diameter, the end cap configured to abut the distal end of the sleeve, and a snap ring configured to be partially located with the divot and abutting the distal end of the end cap.

2. The handle of claim 1, wherein the end cap has an end cap radius of approximately 1.375 inches, the end cap having an end cap height of approximately 0.7 inches.

3. The handle of claim 1, wherein the first end cap internal diameter is approximately 0.625 inches, the second end cap internal diameter is approximately 1.106 inches.

4. The handle of claim 1, wherein the first cylindric section has a first cylindric section radius of approximately 1.109 inches and a first cylindric section height of approximately 1.5 inches.

5. The handle of claim 1, wherein the second cylindric section has a second cylindric section radius of approximately 1 inch and a second cylindric section height of approximately 4.04 inches.

6. The handle of claim 1, wherein the third cylindric section has a third cylindric section radius of approximately 0.62 inches and a third cylindric section height of approximately 0.365 inches.

7. The handle of claim 1, wherein the divot has a divot radius of approximately 0.531 inches and a divot height of approximately 0.047 inches.

8. The handle of claim 1, wherein the divot begins approximately 0.048 inches from the distal end of the third cylindric section.

9. The handle of claim 1, wherein the sleeve has a sleeve radius of approximately 1.375 inches and a sleeve height of approximately 3.469 inches, the sleeve having a sleeve internal diameter of approximately 1.016 inches.

10. The handle of claim 1, wherein the washer has a washer radius of approximately 1.281 inches and a washer height of approximately 0.125 inches, the washer defining an internal diameter of approximately 1.005 inches.

11. The handle of claim 1, wherein the first cylindric section defines a chamfer, wherein the chamfer has a chamfer height of approximately 0.3125 inches.

12. The handle of claim 1, wherein said the first cylindrical section engages the crank assembly.

13. The handle of claim 1, wherein the snap ring holds the sleeve, and the end cap with the rest of the handle.

14. The handle of claim 1, wherein said predetermined sleeve is polyoxymethylene.

15. The handle of claim 1, wherein the end cap is aluminum.

16. The handle of claim 1, wherein the end cap covers the distal end of the handle.

17. A method for improving operation of a crank assembly; said method comprising the steps of:

(a) providing a crank assembly;

(b) providing a handle having an elongated extension member having a first cylindric section disposed on one end of the elongated extension member, the handle having a sleeve having a generally cylindrical shape located on a second cylindric section of the elongated extension member, wherein the second cylindric section abuts the first cylindric section, the handle having a washer having a generally cylindrical shape, the washer configured to be located around the second cylindric section, the washer abutting the sleeve and the first cylindric section, the handle having an end cap having a generally cylindrical shape, wherein a third cylindric section of the elongated extension member is configured to be located within a first end cap internal diameter of the end cap, a distal portion of the second cylindric section configured to be located within a second end cap internal diameter of the end cap, the end cap configured to abut the distal end of the sleeve, the handle having a snap ring configured to be partially located with the third cylindric section of the elongated extension member and abutting the distal end of the end cap, and (c) pressing the first cylindric section of the elongated extension member into distal end of the crank assembly.

18. The method of claim 17 further comprising the step of removing at least a portion of an existing handle member of the crank assembly.

* * * * *